United States Patent [19]

Aragona et al.

[11] 4,246,663

[45] Jan. 27, 1981

[54] HOT TUB COVER

[76] Inventors: Anthony J. Aragona, 2124 Labette Manor Dr., Apt. L-13, Little Rock, Ark. 72205; Michael E. La Plante, 10217 E. 63rd Ter., Raytown, Mo. 64133

[21] Appl. No.: 76,173

[22] Filed: Sep. 17, 1979

[51] Int. Cl.[3] ..... E04H 3/16; E04H 3/18

[52] U.S. Cl. ..... 4/500; 4/503; 4/498; 4/534; 4/580

[58] Field of Search ..... 4/172, 172.12, 172.11, 4/172.19, 172.13, 172.14, 173

[56] References Cited

U.S. PATENT DOCUMENTS

| | | | |
|---|---|---|---|
| 3,008,148 | 11/1961 | Vierling | 4/172.12 |
| 3,443,265 | 5/1969 | Hauck | 4/172.12 |
| 3,469,587 | 9/1969 | Folkes | 4/172.12 |
| 3,475,768 | 11/1969 | Burton | 4/172.12 |
| 3,683,427 | 8/1972 | Burkbotz | 4/172.12 |
| 4,122,562 | 10/1978 | Sorrentino | 4/172.12 |
| 4,136,408 | 1/1979 | Dahlbeck et al. | 4/172.12 |

*Primary Examiner*—Henry K. Artis

*Attorney, Agent, or Firm*—D. A. N. Chase; Michael Yakimo, Jr.

[57] ABSTRACT

A generally hemispherical dome designed to cover a hot tub comprises a pair of successively smaller spherical shells, generally quadrantal in configuration, which are pivotally connected to a pin member vertically disposed through the superimposed apexes of the respective shells. A deck surrounding the perimeter of the hot tub provides basal support to the shells as well as a bearing surface for roller wheels attached along the base of the smaller shell. Upon affixation of the larger shell to the deck the smaller shell is rotated about the pin member through a range of superjacent positions relative to the fixed shell. A plurality of arcuate ribs form the framework of each shell and extend from the respective base towards the apex thereof for connection to a circular rim member. Brace members within the rim are rotatable about the pin member extending therethrough to provide rotation to the smaller shell. The ribs are adapted to support canopy material with selected degrees of shell rotation presenting a corresponding amount of enclosure to the hot tub therebelow.

20 Claims, 7 Drawing Figures

HOT TUB COVER

BACKGROUND OF THE INVENTION

This invention relates to hot tub covers and more particularly to a generally hemispherical dome comprising a pair of shells adapted for a range of superjacent positions corresponding to a variable enclosure of the hot tub therebelow.

The use of hot tubs for both therapeutic and recreational purposes is a burgeoning one. Desiring year-round use, it is advantageous to have a cover associated with the hot tub so as to protect the water and occupants from undesirable weather and other foreign elements. Also, occupants of the tub may desire a certain amount of privacy during use.

Analogous desires have been encountered in the use of swimming pool covers which resulted in various types of enclosures for a swimming pool. However, these covers were of a permanent type which decreased their consumer appeal. As consumers did not always wish to have a full enclosure, especially during the more moderate seasons, attempts were made to offer various types of enclosures which could be easily removed. However, these resulting structures were relatively bulky in construction and had relatively complex means to enable the cover to be removed from an enclosing position.

The present invention has been particularly designed for hot tubs and comprises a pair of shells, which are generally quadrantal in configuration to provide a generally hemispherical dome to the hot tub therebelow. The shell designs are of successively smaller configurations so as to allow a superjacent positioning of one shell with the other as provided by a pivot assembly so joining the shells at their respective apexes. The shells are supported in their functional position by a planar deck extending outwardly from the perimeter of the top of the hot tub. Upon rotation of the smaller shell successively smaller degrees of enclosure are presented to the occupants of the tub ranging from a fully enclosed hemispherical dome to a quadrantal overlay of the hot tub upon rotation of one shell into a complete superjacent relationship with the other.

It is a general object of this invention to provide a cover for a hot tub which allows use of the hot tub during enclosure thereof.

Another general object of this invention is to provide a cover for a hot tub comprising a pair of shells joined for a range of superjacent relationships one to the other.

Another object of this invention is to provide a hot tub cover, as aforesaid, wherein each shell comprises a framework structure adapted to support various types of canopy material thereon.

A more particular object of this invention is to provide a hot tub cover, as aforesaid, which has a pivot assembly joining the two shells for rotation of at least one of the shells about a pivot member incorporated therein.

Still another important object of this invention is to provide a pair of quadrantally spherical shells joined for a range of superjacent relationships one to the other for providing a generally hemispherical dome at full enclosure of the hot tub therebelow.

A more particular object of this invention is to provide a hot tub cover, as aforesaid, having a minimum of moving parts.

Another particular object of this invention is to provide a hot tub cover, as aforesaid, which is easily supported over the top of the hot tub.

Another object of this invention is to provide a hot tub cover, as aforesaid, which is simple to manufacture and assemble as well as efficient in operation and use.

Other objects and advantages of the invention will become apparent from the following description taken in connection with accompanying drawings, wherein are set forth by way of illustration and example, and not limitation, certain embodiments of this invention.

DESCRIPTION OF THE PREFERRED EMBODIMENTS

Figure 1:
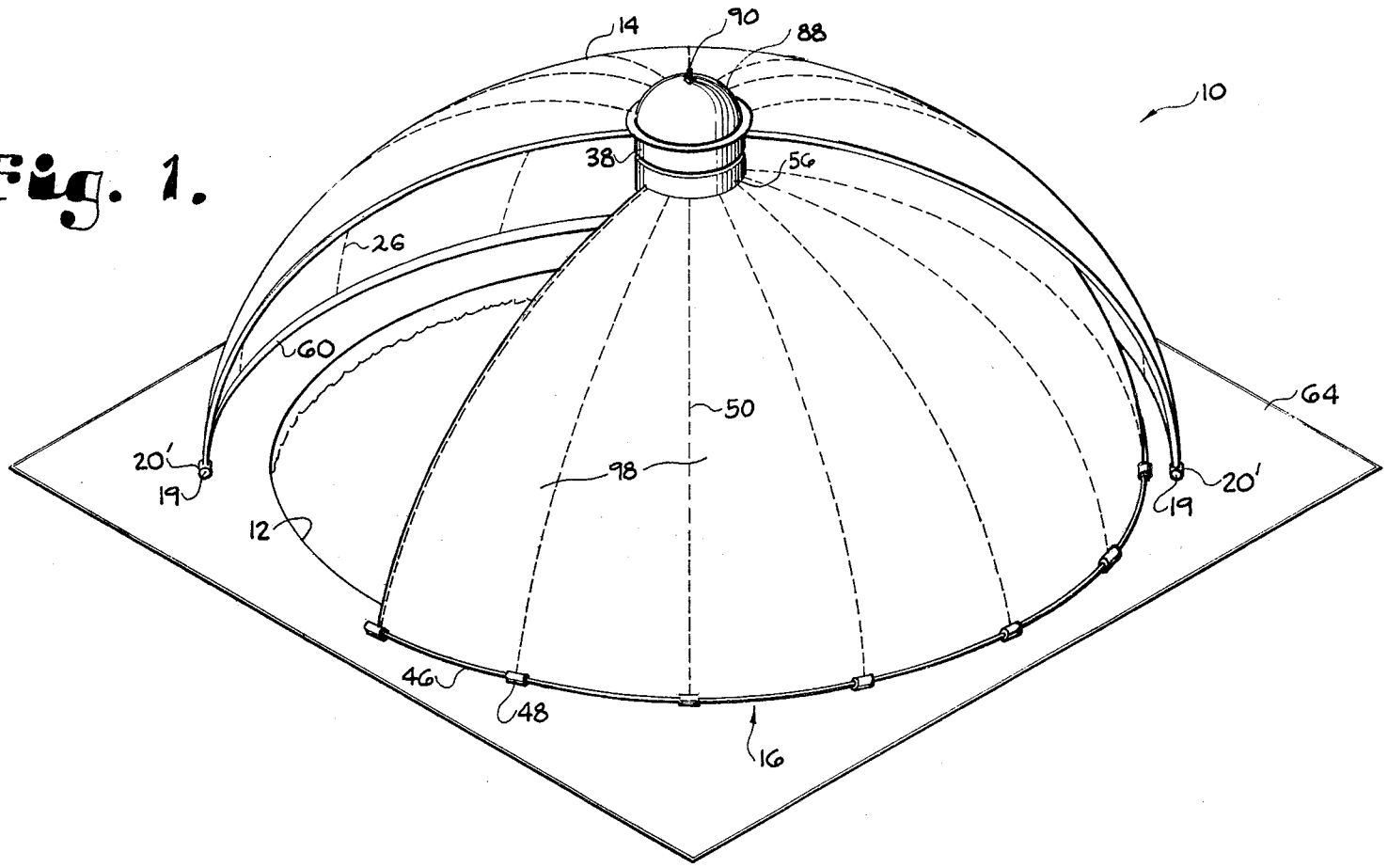
FIG. 1 is a perspective view of the hot tub cover showing the rotating shell of the hot tub cover at a selected superjacent relationship relative to the fixed shell of the hot tub cover.

Referring more particuarly to the drawings, FIG. 1 shows the cover 10 as a generally hemispherical dome positioned over the hot tub 12. The cover 10, as shown includes first and second spherical shells 14 and 16 which are generally quadrantal in configuration in order to form the hemispherical cover 10. The shells 14 and 16 are of successively smaller configurations and, as such, are adaptable for superjacent positioning above the hot tub 12 as to be subsequently explained.

The first shell 14, of a generally larger quadrantal configuration relative to that of the second shell 16, includes a generally simicircular rail member 18 defining the perimeter of the shell 14 along the base thereof. A plurality of T-shaped sleeve fittings 20 are slidably mounted to the rail 18 by insertion of the rail 18 through the ring section 22 of each fitting 20. Integral within each fitting 20 is an internally threaded socket 24 in the vertically extending portion thereof. Terminal fittings 20' have end caps 19 therein preventing projection of rail 18 ends therethrough.

A plurality of arcuate strut members 26 defining the spherical configuration of the shell 14 are joined to the fittings 20 by means of threaded connectors 28. Comprising each connector 28 is a nut 34 with lip to retain a split ring 35 therein and a tubular externally threaded male member 36 threadably engaged at one end to socket 24 of the fitting 20.

Upon insertion of the strut lower end 30 into male member 36, encompassing nut 34 is engaged to the second end of member 36. Upon tightening the nut 34 thereto split ring 35 is compressed around the strut lower end 30 so as to clamp such end within the nut 34 and thereby join the strut 26 to fitting 20. The arcuate struts 26 extend towards the apex of the first shell 14 and are supported at their extending position by a circular ring member or rim 38. Upon connection thereto, the rim 38 maintains the plurality of struts 26 at a position presenting the configuration of the first shell 14.

Providing for such connection of the upper ends 32 of the struts 26 are a plurality of socket-like projections as provided by threaded male members 40 inserted through the rim 38 and retained therein by nut 39. Upon insertion of the strut upper end 32 into socket 40, nut 42 is engaged to the threaded end of socket 40. Upon tightening the nut 42 thereto split ring 43 is compressed about the strut upper end 32 so as to clamp such end within the nut 42 and thereby provide reception of strut 26 into socket 40. Upon connection of each strut 26 to the rim 38 the main body of shell 14 is then formed.

Figure 3:
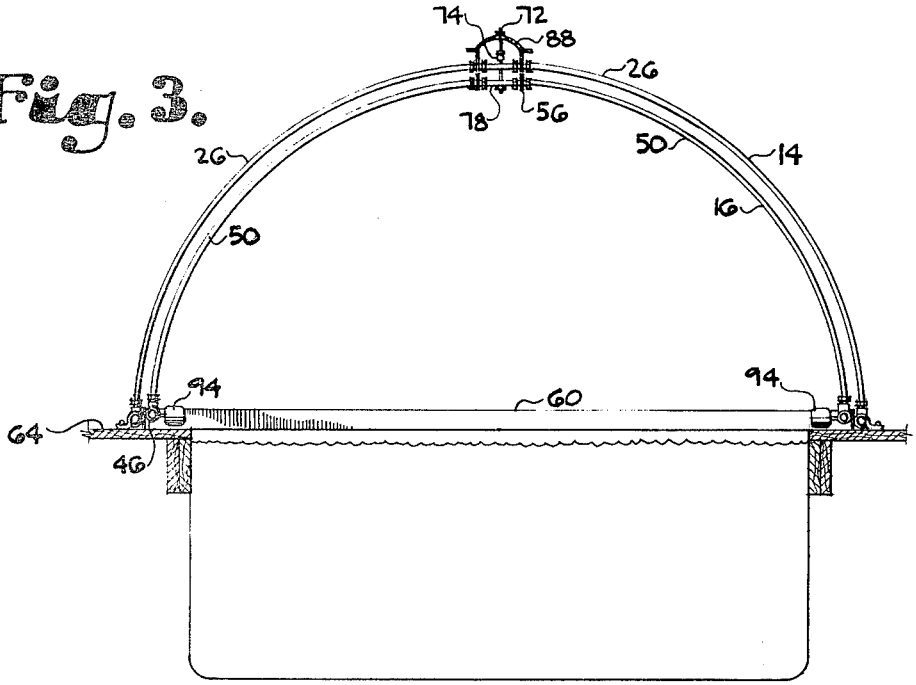
FIG. 3 is a sectional elevation view taken along line 3—3 in FIG. 2 with the canopy material in place.
Figure 2:
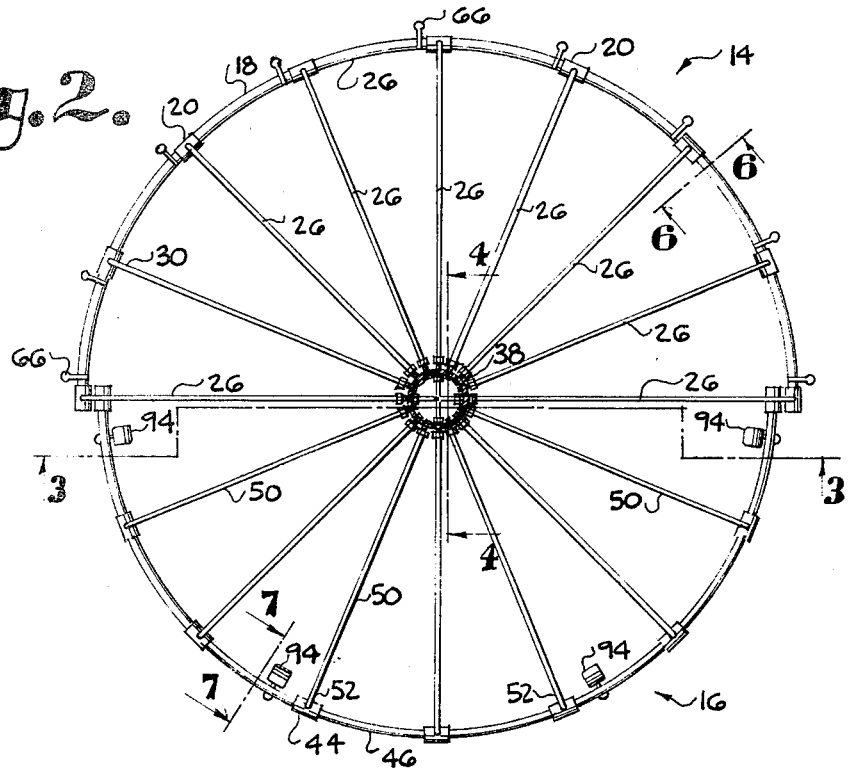
FIG. 2 is a top planar view showing the shells as respective framework structures comprising a plurality of arcuate struts with the canopy material removed therefrom and the shells in a selected position to fully enclose a hot tub when placed therebelow.

The second shell 16 is similar in construction to that of the first shell 14. The rail member 46 of the second shell 16 is of a successively smaller spherical radius than that of the first shell 14 so as to enable the first shell 14 to be easily positioned in a superjacent or overlying position relative to the second shell 16 as shown in FIGS. 1 and 3. The second shell also has fittings 44 slidably mounted to the rail 46 as the above described T-shaped fittings 20 which joins the lower end 52 of each strut member 50 thereto as provided by the above described connectors 28. Again, the respective strut members 50 extend toward the apex of the second shell 16 but are intercepted in their extension by a connection to a second ring member or rim 56. As above described, the upper ends 54 of these strut members 50 are connected to this rim 56 by functional engagement of the nuts 58, with split ring member 59 therein, attached to the upper end 54 of each strut 50 with the socket members 48 projecting from the rim 56 and held thereat by nuts 49.

Figure 6:
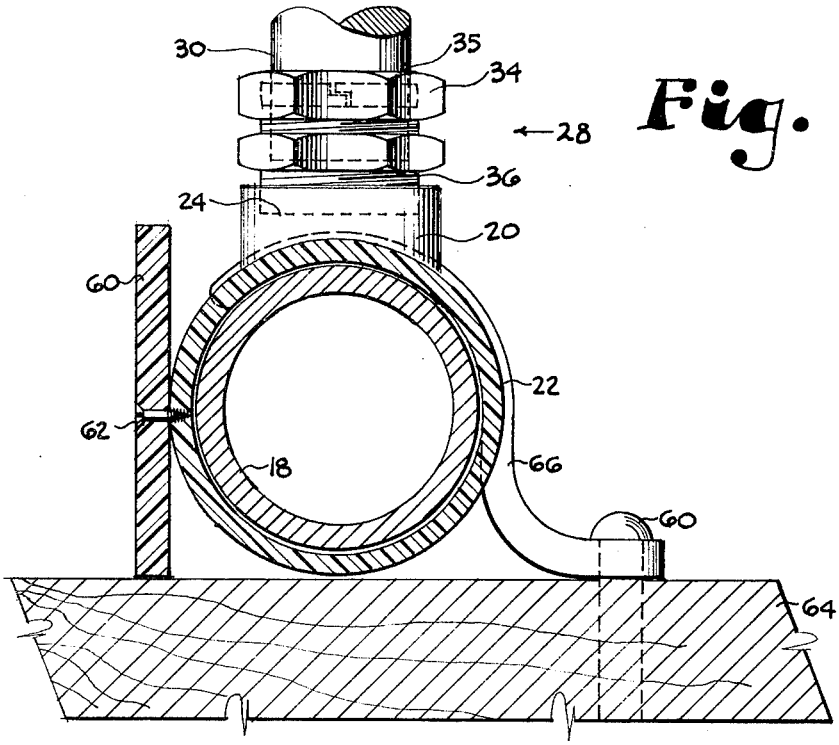
FIG. 6 is a sectional elevation view, on an enlarged scale, taken along 6—6 in FIG. 2 showing the means of affixation of the larger shell of the hot tub cover to the deck therebelow and means for connecting a strut member to the rail member of the shell.

In this preferred embodiment a deck 64 extends outwardly from the perimeter of the hot tub 12 and provides a surface for supporting the respective shells 14 and 16 over the hot tub. As the shells 14 and 16 are of successively smaller configurations, a deck having a planar surface will provide such support. The first shell 14 is fixed to the deck 64 by means of anchor straps 66 connected to the deck 64 by bolts 60 or the like with the straps 66 firmly extending about the rail 18 as shown in FIG. 6. In position the first quadrantally shaped shell 14 generally extends over half of the top of the hot tub 12. It is understood that other types of supports may present such a position to the shells 14 and 16 over the hot tub 12.

Upon positioning of the first shell 14, the second shell 16 is positioned relative thereto with the respective rims 38 and 56 disposed one above the other so as to have a concentric upright axis extending through the superimposed shells 14 and 16 at the apexes thereof. As the second shell 16 is to rotate about this upright axis, it is not fixedly mounted to the deck 64.

Figure 4:
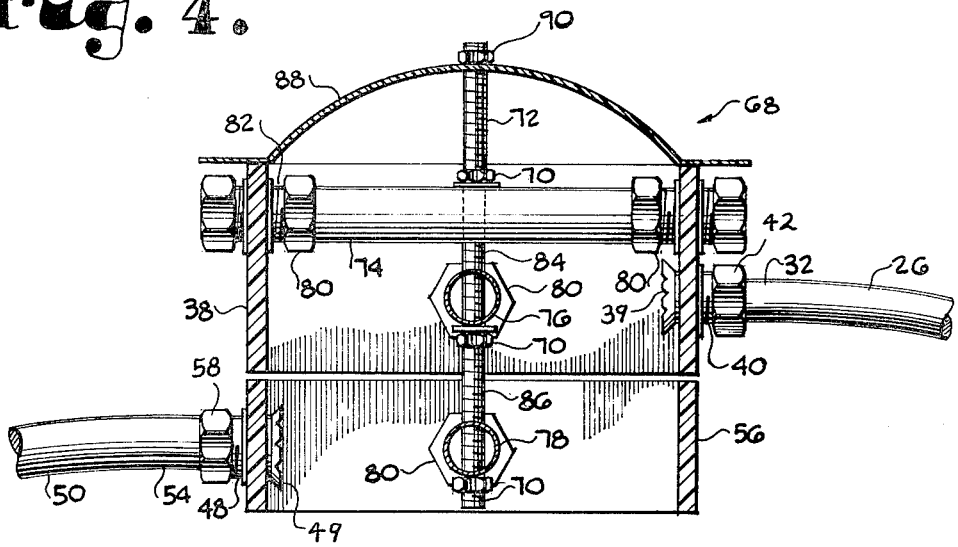
FIG. 4 is a sectional elevation view, on an enlarged scale, taken along line 4—4 in FIG. 2 showing the rim members of the respective shells for supporting the upper ends of the struts and their pivotal connection to the common shaft member extending therethrough.
Figure 5:
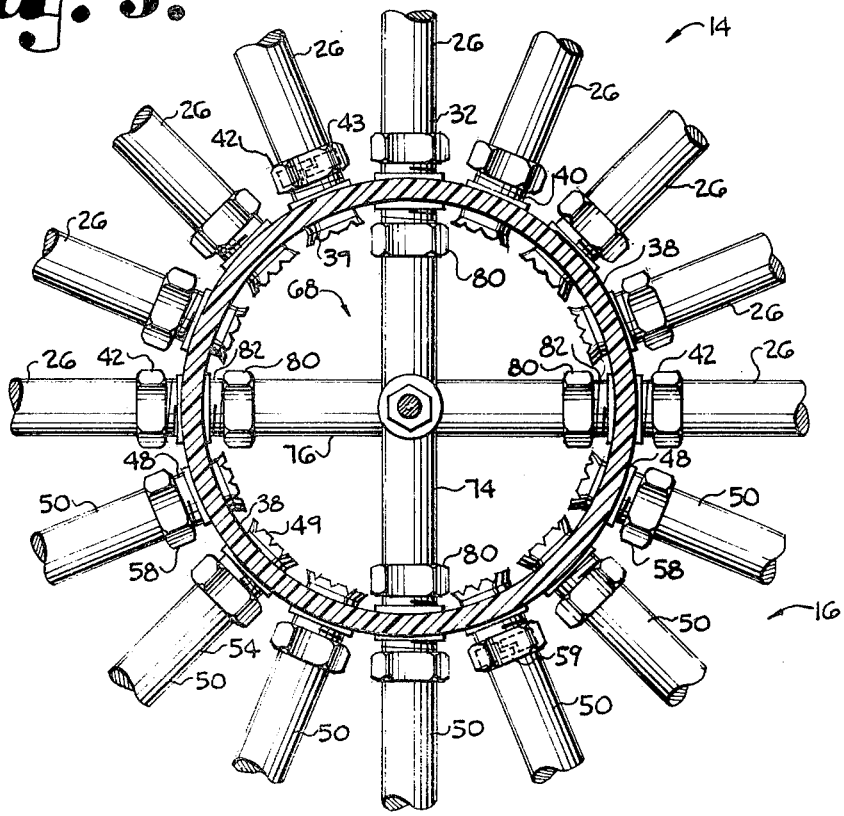
FIG. 5 is a fragmentary top planar view, on an enlarged scale, of the framework structure shown in FIG. 2.

A pivot assembly generally designated as 68 provides a joining of the first and second shells 14 and 16 as well as the desired rotation of the second shell 16 about the upright axis. The assembly 68 generally comprises a vertical shaft 72 lying along this upright axis and passing through the respective brace members 74, 76 and 78 of the first and second compression rings 38 and 56. As shown in FIG. 4, the first rim 38 has a pair of transverse braces 74 and 76 connected to the interior thereto by means of integrally threaded nut-like connectors 80 attached to the end of the braces 76 and 78 and engaging threaded projections 82 of selected rim sockets 40 extending inwardly of the rim 38. Vertically aligned apertures 84 are inserted through the braces 74 and 76 allowing for a vertical disposition of the shaft 72. The second rim 56 has a similarly connected transverse brace 78 with aligned apertures 86 therein and in alignment with apertures 84 of the braces 74 and 76 to receive the lower portiop of the projecting shaft 72.

Bushings 70 are inserted into selected apertures 84 and 86 so as to reduce friction between the shaft 72 and respective braces 74, 76 and 78. Atop the first rim 38 lies a crown member 88 held in place atop the first rim 38 by a nut 90 engaging the upper threaded portion of the shaft 72 extending beyond the crown 88. The engaged nut 90 holds the shaft 72 at a pivot position presenting spoke-like braces 74, 76 and 78 relative to the rims 38 and 56 for pivotal connection of the shells 14 and 16 thereto.

Figure 7:
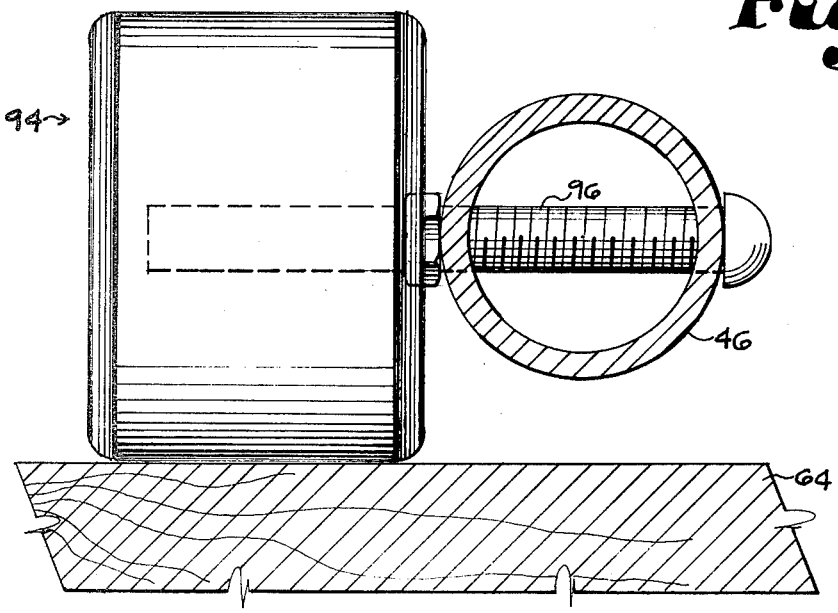
FIG. 7 is an elevational view, on an enlarged scale, along line 7—7 in FIG. 2 showing a roller wheel attached to the rail member of the rotating shell.

Roller wheels 94 are attached along the rail member 46 of the second shell 16 as shown in FIG. 7 so as to vertically displace the rail 46 from the deck 64 for prevention of friction therebetween. The wheels 94 are connected to the rail 46 by means of an axle 96 extending through the rail 46 with the wheel member 94 rotatably mounted at the free end thereof.

Upon positioning as above described, the brace member 78 is free to pivot about the shaft 72 providing a corresponding rotation to the second shell 16. Upon such rotation a range of superjacent relationships between the first and second shells 14 and 16 are presented from a minimal superjacent relationship as presented by the hemispherical cover to a complete superjacent relationship upon rotation of the second shell 16 into the confines of the first shell 14. A bumper strip 60 is attached to the interior of the fixed rail 18 by means of screw members 62 to guard against abrasion between the rails 18 and 46 as well as the head of axle 96 extending therefrom.

The respective strut members 26 and 50 of each shell 14 and 16 are designed to support canopy material 98 attached thereto such as plexiglass, canvas material or the like according to the desires of the user.

Loops (not shown) can be sewn to the underside of the canopy material 98 for the extension of the struts 26 and 50 therethrough before fastening of the struts 26 and 50 to the rails 18 and 46. Thus, upon attachment of the canopy material to the respective struts 26 and 50 of the respective shells 14 and 16, a variable canopy can be presented to the users of the hot tub therebelow, as variously presented by the above range of rotation of the second shell 16.

Furthermore, it is understood that each shell may be a monolithic structure formed from plexiglass or other suitable material, so as to eliminate said struts 26 and 50 and accompanying elements.

Upon use of such monolithic shells a pin member extending along an upright axis through the superimposed apexes of the shells can provide the desired pivot for rotation of at least one of the shells about the upright axis. As so constructed, the roller wheels, as above described, can be attached to the base of the rotating shell.

Having then described the invention, what is claimed as new and desired to be secured by Letters Patent is:

1. An adjustable cover, having a primary configuration, for protective extension over a hot tub or similar apparatus comprising:

first and second shells having complementary configurations therebetween for forming said cover primary configuration upon placement of said first and second shells at an initial closure position, said first and second shell configurations being relatively sized therebetween to allow said first shell to overlie second shell in a spaced-apart relationship upon placement of said second shell therebelow; and means mounting at least one of said shells for pivotable rotation about an upright axis passing therethrough and providing for movement of said shell from said initial closure position upon said rotation, said pivotable shell cooperating with said relative shell sizes to present a range of selectable superjacent relationships between said first and second shells during said shell movement, said selectable shell relationships corresponding to a selectable variance of said shells from said primary configuration whereby to adjust the degree of said protective extension offered by said cover.

2. The device as claimed in claim 1, wherein at least one of said shells further comprises:

a rail member defining the base of said shell;

a plurality of struts for supporting a canopy thereon, each of said struts having first and second ends with said first end of each strut connected to said rail in spaced apart relationships therealong; and means maintaining said plurality of struts at a position presenting the configuration of said shell.

3. The device as claimed in claim 1, wherein each shell further comprises:

a rail member defining the base of said respective shell; and a plurality of struts for supporting a canopy, each of said struts having first and second ends with said first end of each strut of said respective shell attached to said respective rail in spaced apart relationships therealong; and means maintaining said respective plurality of struts at a position presenting the configuration of said respective shell.

4. The device as claimed in claim 3, wherein each naintaining means comprises:

an upper support member disposed above said respective rail and adapted to receive said second end of each strut of said respective plurality of struts; and means for fastening said second end of each strut to said respective upper support member upon said reception.

5. The device as claimed in claim 3, wherein each naintaining means comprises:

an upper support member disposed above said respective rail and adapted to receive said second end of each strut of said respective plurality of struts;

a plurality of projections extending outwardly from said respective upper support member with each projection corresponding to a strut of said respective plurality of strut; and means for fastening said second end of each strut to said corresponding projection.

6. The device as claimed in claim 5, wherein said projections are threaded and said respective fastening means comprises a threaded connector attached to said second end of each strut for engaging said corresponding threaded projection.

7. The device as claimed in claim 4, wherein said respective upper support member has a plurality of sockets therein, each socket corresponding to a strut of said plurality of struts and receiving a portion of said second end of said corresponding strut therein.

8. The device as claimed in claims 4 or 5, wherein said mounting means comprises:

a brace member joined to each respective upper support member and having an aperture therein, said braces disposed one above the other to present vertically aligned apertures with said upright axis passing therethrough;

a pin member extending through said apertures to provide a pivot for said respective braces; and means for holding said pin member at said pivot position.

9. The device as claimed in claim 8, wherein said respective upper support member is a rim with said respective plurality of struts extending outwardly therefrom and said respective brace member transverses said respective rim to present a spoke-like member thereto.

10. The device as claimed in claims 1, 2 or 3, wherein said mounting means comprises:

a pin member defining said upright axis; and means pivotally connecting at least one of said shells to said pin member to provide said movement of said connected shell about said upright axis.

11. The device as claimed in claims 2 or 3 further comprising:

means for providing said connection of said first end of said respective strut to said respective rail including a fastener attached to said first end of said respective strut and a plurality of joint members mounted along said respective rail with each joint member corresponding to a strut of said respective plurality of struts and adapted to engage said fastener of said corresponding strut.

12. The device as claimed in claim 11, wherein said respective fastener is threaded and said respective joint member is adapted to threadably engage said threaded fastener.

13. The device as claimed in claim 11, wherein said respective joint member is a fitting adapted to be slidable along said respective rail.

14. The device as claimed in claims 1, 2 or 3 further comprising means for supporting said shells over said hot tub.

15. The device as claimed in claim 14, wherein said support means comprises a deck positioned about the perimeter of said hot tub for placement of said shells thereon.

16. The device as claimed in claim 15, further comprising means for fixedly positioning one of said shells to said deck.

17. The device as claimed in claim 15, further comprising a plurality of wheels mounted to at least one of said shells and contacting said deck for rolling movement therealong during said shell movement.

18. The device as claimed in claims 1, 2 or 3, wherein each of said shells is quadrantally spherical in configuration to provide a generally hemispherical cover to said hot tub upon said placement of said first and second shells at said initial closure position.

19. The device as claimed in claims 2 or 3, further comprising:

canopy material for attachment to said respective plurality of struts; and means for fastening said canopy material to said respective plurality of struts.

20. The device as claimed in claim 1, wherein at least one of said shells is of a monolithic structure.

* * * * *